United States Patent [19]

Almeda, Jr.

[11] 4,284,000

[45] Aug. 18, 1981

[54] MATERIAL COMPACTING APPARATUS

[76] Inventor: Benjamin M. Almeda, Jr., 3415 24th Ave., West, Seattle, Wash. 98199

[21] Appl. No.: 132,882

[22] Filed: Mar. 24, 1980

[51] Int. Cl.[3] ..... B30B 15/06

[52] U.S. Cl. ..... 100/229 A; 100/244; 100/269 R; 100/295

[58] Field of Search ..... 100/229 A, 229 R, 269 R, 100/244, 278, 295, 214, 251, 296, 240, 245; 53/527; 141/73, 80

[56] References Cited

U.S. PATENT DOCUMENTS

| | | | |
|---|---|---|---|
| 311,824 | 2/1885 | Ford | 100/229 R |
| 2,757,603 | 8/1956 | Wilson et al. | 100/229 A |
| 2,782,710 | 2/1957 | Fishburne | 100/229 R |
| 3,734,008 | 5/1973 | Wilhelm | 100/269 R |
| 3,765,148 | 10/1973 | Ippolito | 100/229 A |
| 3,868,903 | 3/1975 | Montalbano | 100/229 A |
| 3,880,072 | 4/1975 | Ord | 100/229 A |
| 4,054,088 | 10/1977 | Nee | 100/229 A |

FOREIGN PATENT DOCUMENTS

| | | | |
|---|---|---|---|
| 2442050 | 3/1976 | Fed. Rep. of Germany | 100/229 R |

*Primary Examiner*—Billy J. Wilhite

*Attorney, Agent, or Firm*—Graybeal & Uhlir

[57] ABSTRACT

An apparatus for tightly compacting material within a wheeled, open top container including a frame composed of a stationary base and a overhead section disposed above the container and coupled to the frame base section by a plurality of telescoping columns which permit the overhead section to raise and lower relative to the container. A plurality of nominally relaxed tension lines extend downwardly from the frame overhead section to interconnect with the upper rim portion of the container. The apparatus also includes a pressing head suspended below the frame overhead section by a pair of spaced apart hydraulic cylinders which are retractable to lift the pressing head to an elevation above the container or extendible to force the pressing head downwardly into the container. As the pressing head pushes against the material within the container, a reaction force is generated which initially causes the frame overhead section to lift upwardly until the tension lines are drawn taut. Once taut, the tension lines serve to hold the frame overhead section stationary with respect to the container while the pressing head compacts the material within the container. As a consequence, the compression load imposed on the material within the container by the pressing head is transferred back to the overhead section by the tension lines and is not imposed on the container wheels.

35 Claims, 4 Drawing Figures

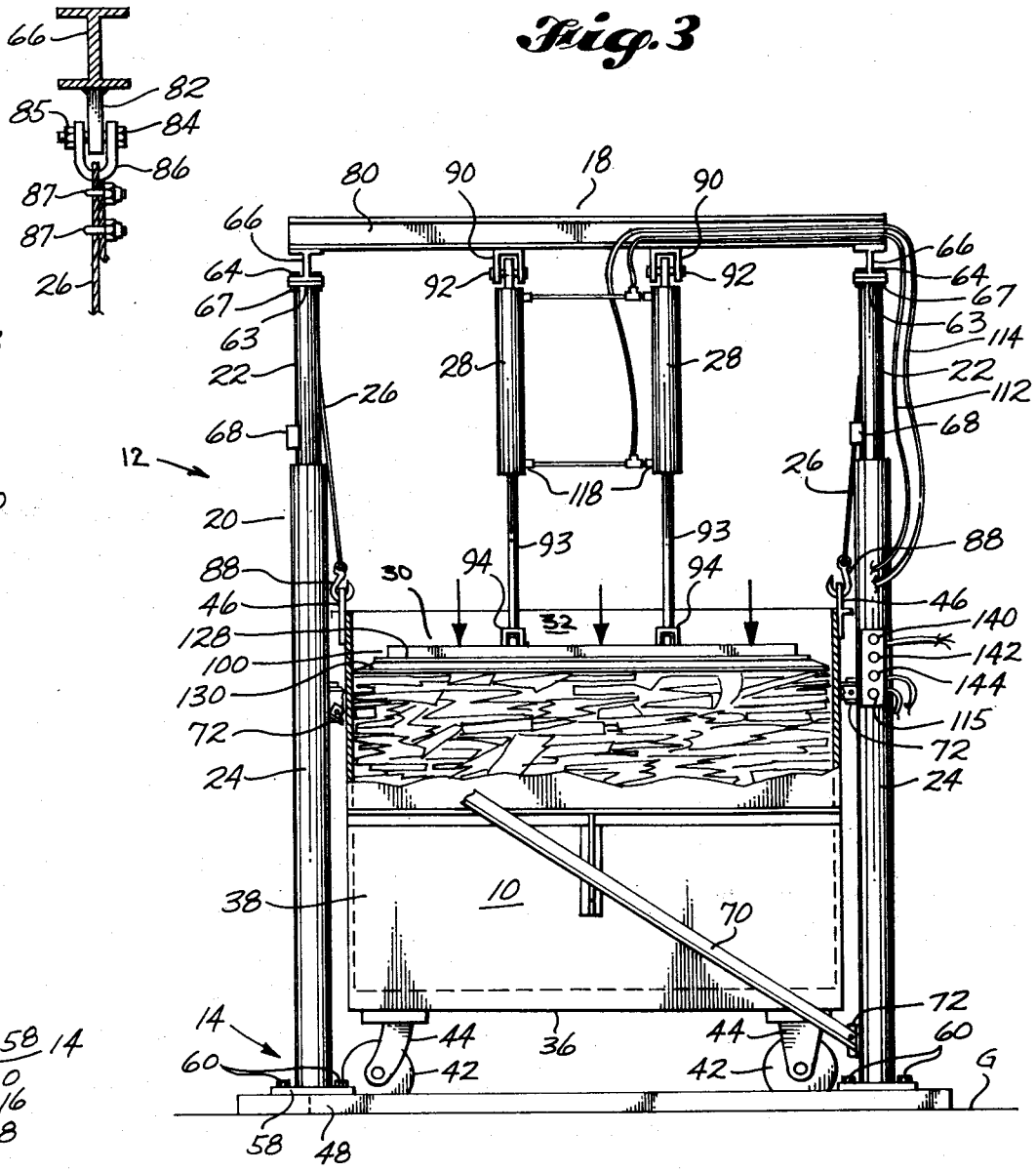
Fig. 3
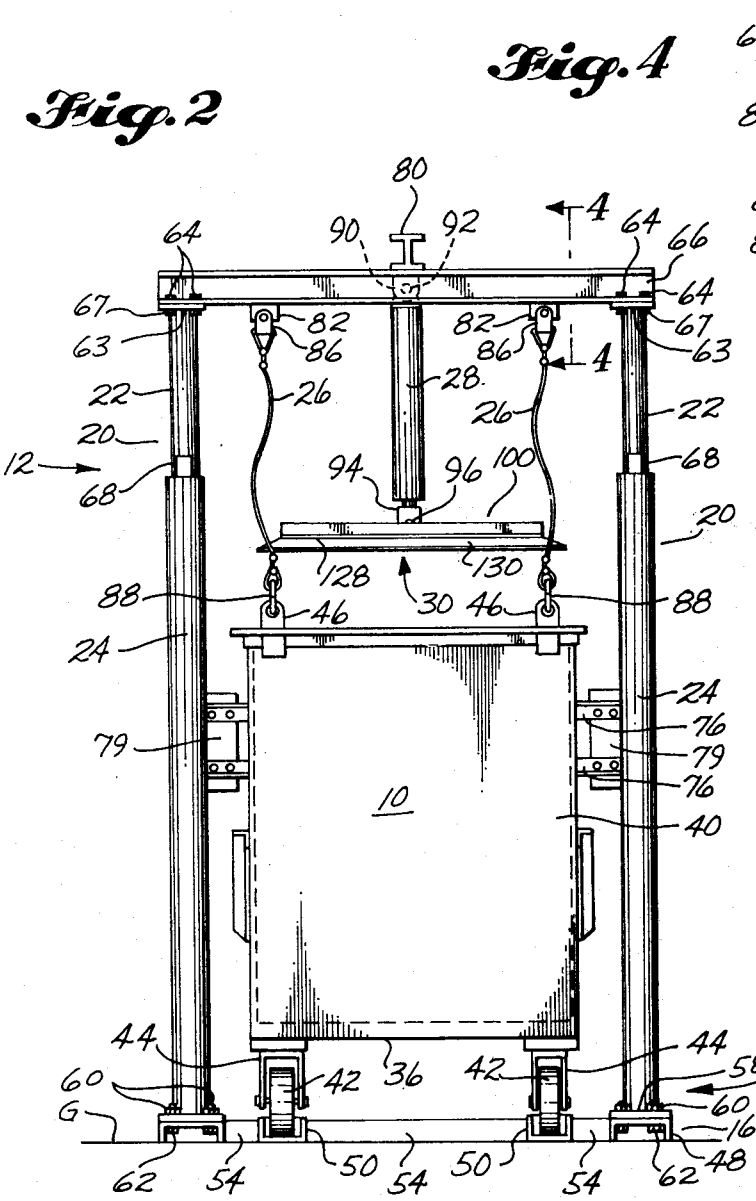
Fig. 4
Fig. 2

MATERIAL COMPACTING APPARATUS

FIELD OF THE INVENTION

The present invention relates to presses, and more particularly to a new apparatus for compacting refuge and other materials within an open top container mounted on wheels without transmitting the force of compaction through the wheels.

BRIEF DESCRIPTION OF THE PRIOR ART

One known type of apparatus for compacting materials within a container is similar in construction to the typical press which has been used for hundreds of years to squeeze grapes. This press generally includes a flat base for supporting a barrel or other circular container, and an overhead block spaced above the barrel by a plurality of upstanding legs. Typically a flat compacting plate is connected to the lower end of an elongate screw which engages a threaded bore extending vertically through the overhead block. As the screw is advanced, the compacting plate is forced downwardly into the barrel to squeeze the material located therein. An example of this type of apparatus is disclosed by U.S. Pat. No. 311,824 to Ford.

One disadvantage of this particular construction is that the load of compaction is transmitted downwardly through the bottom of the barrel to the underlying base structure. Thus, if the barrel is mounted on axled wheels or rollers to facilitate movement, the force of compaction is also transferred through the wheels and their axles. However, since the force of compaction generated by the screw is usually much larger than the load carrying capacity of the wheels or their axles, these components will fail from being overstressed. As a consequence, several alternative pressing structures have been developed to avoid transmitting the force of compaction through the wheels of the barrel or other container.

In one such structure, as exemplified by Fishburne, U.S. Pat. No. 2,782,710, the base of a press is constructed with a set of tracks for guiding the wheels of a barrel shaped container. The tracks are resiliently supported by underlying leaf springs which extend outwardly from a central portion of the base. A rigid support frame extends upwardly from the central portion of the base to closely underlie the container. Thus, when a compacting plate is pressed downwardly into the barrel, the load of compaction imposed by the plate causes the leaf springs to deflect so that the container bottoms on the solid, central support frame. As a consequence, the load of compaction is carried by the central support frame rather than by the container wheels.

In another known type of compacting system, designed to avoid transmitting the load of compaction through the container wheels, a container is mounted on wheels which are axled to yolks. A rod extends upwardly from each yolk and through holes provided in the bottom of the container. A compression spring is engaged over each vertical rod to push against the top of the yolk and the underside of the container bottom. Thus, whenever an overhead ram applies a compressing load to the material housed within the container, the container slides downwardly relative to the vertical rods against the biasing force of the compression springs. A rigid, raised platform, straddled by the container wheels, is centrally disposed beneath the container when it is positioned below the compacting ram.

The platform serves to limit the downward travel of the container and support it during compaction so that the load of compaction is not borne by the wheels. A drawback of this particular container construction is that the compression springs are subject to failure from, for instance, fatigue or even corrosion. If one of the springs fails or becomes significantly weakened, the container will tilt and the rods of the remaining wheels will bind within their respective openings thereby preventing downward travel of the container. Furthermore, it may not be economically or structurally practical to alter existing wheeled containers, such as garbage bins provided by disposal companies, to incorporate the above-described vertical rods and springs. An example of a compacting system of this type is disclosed by U.S. Pat. No. 3,765,148 to Ippdito et al.

In another type of compacting apparatus, in which the container wheels theoretically do not have to bear the load of compaction, a container is provided with rollers constructed from resilient material. When subjected to the load of compaction, the rollers are compressed to thereby bottom the container downwardly on an underlying surface so that the compaction load is carried by the bottom of the container rather than by the rollers. One disadvantage of this particular construction is that it may be difficult to design rollers which are firm enough to carry the weight of a fully loaded container, such as a large garbage container, and still flexible enough to enable the container to lower far enough to bottom on an underlying support surface without overloading the wheels or their axles. An example of this particular type of compacting apparatus is disclosed by Montalbano, U.S. Pat. No. 3,868,903.

In a further type of compacting apparatus, a stationary compacting unit is composed of a storage bin and a horizontally acting ram for pushing the garbage out the end of the stationary bin and into the adjacent open end of a portable container. A linkage mechanism is provided to keep the stationary and portable containers coupled together during the ramming process. The ramming head, which pushes against the garbage, is detachably connected to a ramming cylinder to also serve as a closure door for the open end of the portable container. Once the portable container is filled, it is loaded on the back of a truck and then transported to a dump site where it is emptied. An example of this particular type of compactor is disclosed by Ord, U.S. Pat. No. 3,880,072.

In an additional type of compacting apparatus, a wheeled hand truck is adapted to serve as a detachable front wall of a rectangularly shaped receptacle. The receptacle has an open top through which material to be compacted is dropped. The compactor also includes a press plate which is connected to the lower end of a pair of vertically disposed racks, each of which engages with a corresponding pinion. Once the receptacle is filled, the pinions are manually rotated to force the press plate downwardly into the container thereby compacting the material previously placed therein. An example of this type of compacting apparatus is disclosed by Wilson et al, U.S. Pat. No. 2,757,603.

SUMMARY OF THE INVENTION

The present invention relates to a novel compactor, especially adapted to compact garbage or other materials placed within a container without overloading the wheels of the container. Garbage containers provided by refuge collection services for restaurants, apartments, manufacturers and other types of commercial subscribers are typically rectangular in shape, having a flat bottom, four side walls and an open top. The present invention, in basic form, is characterized by a frame structure composed of a stationary base section and a movable upper or overhead section, the base section including guideways for guiding the wheeled container into position relative to the frame structure. The frame overhead section is guidably coupled to the base section by a plurality of telescoping columns for movement toward and away from the base section. Each column is composed of an upper tubular section slidably engageable with a lower tubular section. The upper section is fixedly attached to the frame overhead section while the lower section is fixedly attached to the frame base section.

A plurality of flexible tension lines extend downwardly from the frame overhead section to detachably connect with the container. Typically, a hook is fixed to the lower end of each tension line to engage through an aperture formed in the upper rim portion of the container.

A flat, reinforced pressing head is supported below the frame overhead section by a pair of spaced apart fluid rams in the form of double-acting hydraulic cylinders which depend downwardly from the frame overhead section. The rams power the pressing head into the container opening to compact the material located therein and alternatively lift the pressing head to an elevation above the container to provide access to the container so that it can be filled. The pressing head is shaped corresponding to, but sized slightly smaller than, the container top opening to provide a clearance gap between the perimeter of the pressing head and the opening. A flexible seal member extends outwardly from the perimeter of the pressing head to seal the gap between the pressing head and the container opening when the pressing head is disposed within the container. The upper end of both fluid rams are pivotally connected to the frame overhead section while their lower ends are pivotally connected to the pressing head.

When the pressing head pushes downwardly against the garbage or other material located within the container, the reaction force generated causes the frame overhead section to raise or shift upwardly relative to the frame base section thereby drawing taut the tension lines which are otherwise in relaxed condition. When the lines are tensioned, the frame overhead section is precluded from rising any further upwardly. As a consequence, the reaction force generated by the compacting action of the pressing head is transmitted upwardly from the container through the tension lines and to the frame overhead section. As a result, none of the load of compaction is borne by the container wheels or the structure utilized to mount the wheels on the container, which components typically are not designed to carry loads much beyond the weight of the garbage and the container itself.

It is a primary object of the present invention to provide a compacting apparatus for compacting materials within a wheeled container without imposing the load of compaction on the wheels.

Another object of the present invention is to provide a compacting apparatus which may be conveniently used in conjunction with a standard, wheeled garbage bin while requiring only a minimum of alteration to the container and not subjecting the wheels to the force of compaction.

A further object of the present invention is to provide a compacting apparatus wherein the pressing head, which compacts the material within the container, also serves as the cover for the container.

A still further object of the present invention is to provide a compacting apparatus which automatically aligns a storage container in proper position for compacting the material located therein.

Yet another object of the present invention is to provide a compacting apparatus which is extremely easy and safe to operate, and also which requires only a minimum of maintenance.

An additional object of the present invention is to provide a compacting apparatus which is ruggedly constructed but economical enough to manufacture to enable a large proportion of garbage service subscribers to afford one.

Still a further object of the present invention is to provide a compacting apparatus which may be operated only by authorized personnel.

One more object of the present invention is to provide a compacting apparatus which occupies a minimum of ground area, thus enabling it to be used in locations where very little clearance space exists around the perimeter of a garbage container.

BRIEF DESCRIPTION OF THE DRAWINGS

FIG. 2 is an end elevational view of the typical compacting apparatus shown in FIG. 1 with the pressing head shown in upwardly retracted position;

FIG. 3 is a side elevational view of the typical compacting apparatus illustrated in FIG. 1, with portions shown in cross section and specifically showing the pressing head pushing downwardly against the material within the container; and FIG. 4 is cross sectional view taken on line 4—4 of FIG. 2.

DESCRIPTION OF THE PREFERRED EMBODIMENT

Figure 1:
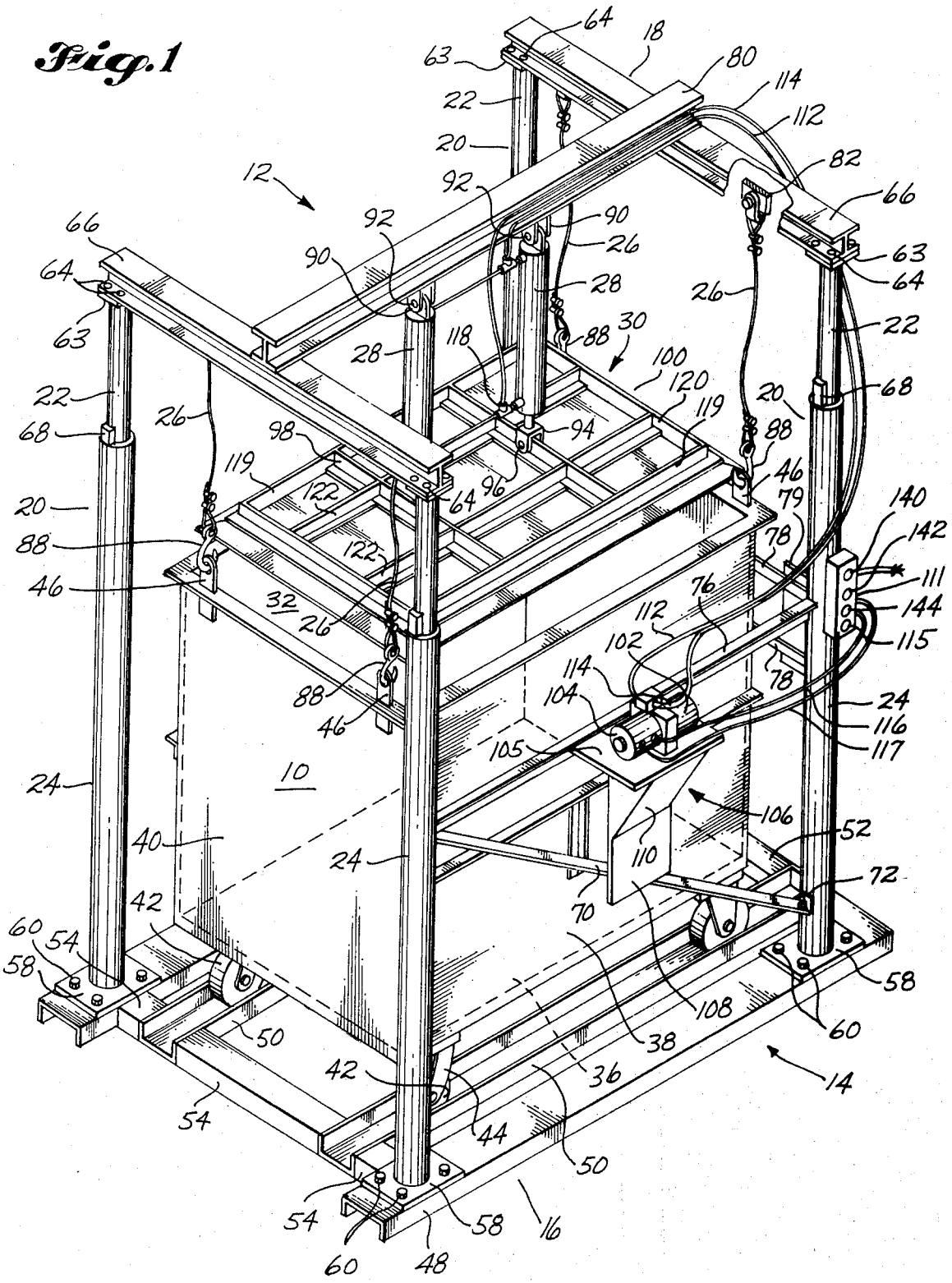
FIG. 1 is an isometric view of one typical embodiment of the present invention, with portions shown broken away for clarity.

Referring initially to FIG. 1, a typical wheeled garbage container 10 is located within a compacting apparatus 12 which is constructed according to the best mode of the present invention currently known to applicant. Compacting apparatus 12, in the preferred form illustrated includes, a frame structure 14 composed of a stationary base section 16 and a movable overhead section or framework 18 interconnected by a plurality of telescoping columns 20. Each column 20 includes an upper tubular member 22 fixedly attached to frame overhead section 18 and slidably engageable within a lower tubular member 24 fixedly attached to frame base section 16. A plurality of flexible tension lines 26 depend downwardly from frame overhead section 18 to detachably connect with an upper rim portion of container 10. In addition, extend-retract members in the form of a pair of double-acting, hydraulic cylinders 28 have their upper end portions pivotally connected to overhead section 18 and their lower end portions fixedly connected to a generally planar, reinforced pressing head 30 which is sized to fit within the open top 32 of container 10. As illustrated in FIG. 2, hydraulic cylinders 28 are upwardly retractable to lift pressing head 30 above the top of container 10 to gain access to the container so that garbage and other refuge can be placed within the container. Hydraulic cylinders 28 also can be extended to force pressing head 30 downwardly into container 10 to compact the garbage located therein. The reaction force generated by pressing head 30, as it pushes downwardly against the garbage within container 10, causes the frame overhead section 18 to raise upwardly thereby extending lines 26. When lines 26 are taut, they prevent further upward movement of frame overhead section 18 thus causing the lines to pull upwardly on container 10 to thereby transmit the force of compaction upwardly through the side walls 38 of container 10 and through the tension lines 26 to overhead section 18.

Referring to FIGS. 1–3, container 10 is illustrated as rectangular in shape having a flat floor 36, a pair of integral side walls 38 extending vertically upwardly from the floor 36 in spaced parallel relationship to each other and a pair of vertical end walls 40 extending vertically upwardly from floor 36 in spaced parallel relationship to each other. This particular shape and construction of container 10 is only one example of the many types of containers which may be used in conjunction with the present invention. Compacting apparatus 12 can readily be adapted for use with containers of sizes and shapes other than container 10 illustrated in FIGS. 1–3.

Container 10 is mounted on four wheels or casters 42 axled to U-shaped mounting yolks 44 attached to the underside of container floor 36. Typically container wheels, such as wheels 42, are designed to carry the weight of container 10 plus the weight of the garbage placed within the container but not the additional load required to adequately compact the material or refuge within the container.

A pair of eye plates 46 are fixedly attached to the upper rim portion of each end wall 40 at a location adjacent the corner of the container by any convenient means, such as by welding. Eye plates 46 are vertically elongate to extend slightly above the upper rim of container 10. A transverse aperture of through hole is provided in the portion of each eye plate 46 extending above the rim of container 10.

Again referring to FIGS. 1–3, frame structure 14 includes a stationary base section 16 which lies on ground G to support frame overhead section 18 above container 10. Base section 16 includes a pair of elongate footing members 48 disposed in spaced parallel relationship to each other at a location laterally outwardly from each side of container 10. Footing members 48 are slightly longer than the length of container 10 and are positioned fairly close to container side wall 38 to minimize the ground area occupied by frame structure 14. Preferably footing members 48 are formed from standard, commonly available, channel-shaped structural steel, but they can be formed in other shapes or from other types of structural steel, such as flat bar, angle iron or I-beams.

Frame base section 16 also includes a pair of elongate guide rails 50 disposed in spaced apart parallel relationship to each other at a location between and at orientation parallel to footing members 48. Guide rails 50 serve to guide and support container wheels 42, and thus are spaced apart a distance corresponding to the width separating wheels 42. Preferably each guide rail 50 is constructed from a channel-shaped structural member disposed so that the flanges extend upwardly from the web which underlies and supports wheels 42. The flanges of guide rails 50 transversely constrain wheels 42 when container 10 is rolled into and out from compacting apparatus 12. Ideally, the vertical height of the guide rail flanges should not extend so far upwardly that they interfere with mounting yolks 44.

As best shown in FIG. 1, a cross member 52 transversely interconnects the end portions of footing members 48 and abuts against the end of guide rails 50 to also serve as a stop member so that container 10 will not roll beyond base section 16 when pushed within compacting apparatus 12. Cross member 52 can be constructed from any convenient structural shape, such as from a square tube or angle iron. Also, cross member 52 can be attached to footing members 48 and cross members 52 by any convenient means, such as by welding.

A three-piece cross member 54 extends between footing members 48 at the end of frame base section 16 opposite cross member 52. Cross member 54 includes a center section which extends transversely between the ends of guide rails 50, and a pair of side sections which extend between each footing member 48 and a corresponding guide rail 50. Positioning the components of cross member 54 at these locations leaves the end of each guide rail 50 open so that container 10 is free to roll onto and off of the guide rails. Cross member 54 likewise can be constructed from any convenient type of structural component such as rectangular tubing or angle iron. Furthermore, the components of cross member 54 can be attached to footing members 48 and guide rails 50 by any convenient means, such as by welding.

As illustrated in FIGS. 1–3, frame 14 also includes four telescoping columns 20 which guide frame overhead section 18 for up and down movement relative to frame base section 16 and container 10. In the preferred form illustrated, each column 20 is composed of lower, outer tube 24 having its lower end fixedly attached to a flat mounting plate 58, for instance by welding. Plate 58 is in turn fixed to the upper surface of an end portion of a footing member 48 by any convenient means, such as by bolts 60 which extend through clearance holes provided in plate 58 and footing member 48 to engage with nuts 62. Each column 20 also includes a smaller diameter, upper, inner tube 22 which closely and slidably engages within outer tube 24. The upper end of each inner tube 22 is fixedly attached to a flat mounting plate 63 which in turn is affixed to the underside of an end portion of a corresponding frame overhead section cross beam 66. Preferably inner tube 22 is welded to its corresponding mounting plate 63 and the mounting plate is preferably bolted to cross beam 66 by capscrews 64 which extend downwardly through clearance holes provided plate 63 and the lower flange of cross beam 66 to engage with nuts 67. It is to be understood that rather than orientating columns 20 in the manner described above, they can be turned upside down so that outer tubes 24 depend downwardly from cross beam 66 while inner tubes 22 extend upwardly from footing members 40. Also, rather than being of circular cross section as illustrated in FIG. 1, outer tube 24 and inner tube 22 can both be constructed in other crosssectional shapes, such as square or rectangular.

Continuing to refer to FIGS. 1–3, a stop plate 68 is fixed to an intermediate portion of each inner tube 22 to abut against the upper end edge of a corresponding outer tube 24. Stop plates 68 serve to limit the engagement of inner tube 22 within its corresponding outer tube 24 to thereby establish the lowermost elevation which frame overhead section 18 is permitted to occupy. Preferably stop plates 68 are welded to inner tubes 22 to prevent their accidental removal therefrom, but it is to be understood that other methods for mounting stop plate 68 can be utilized, such as by bolting. Ideally plates 68 are arcuate in form to match the curvature of inner tubes 22.

Columns 20 are braced together by diagonal side braces 70 which extend diagonally upwardly from the lower end portion of each column outer tube 56 which is located adjacent cross member 52 to intersect an intermediate portion of a corresponding outer tube 56 at the opposite end of frame base section 16. Each end of diagonal brace 70 is bolted to a angle shaped, mounting bracket 72 which in turn is welded to a corresponding outer tube 24. As illustrated in FIG. 1, columns 20 are also interconnected by horizontal side braces 76 which are disposed at an elevation corresponding to the elevation of the upper ends of diagonal side braces 70. Each end of horizontal side brace 76 is also bolted to a mounting bracket 72 which in turn is welded to a corresponding outer tube 24. The columns 20 at the end of frame base section 16 at which cross member 52 is located are interconnected by a pair of vertically spaced, horizontally disposed end braces 78, FIGS. 1 and 2. The ends of each end brace 78 are bolted to a vertically disposed mounting ear 79 extending transversely from each outer tube 56. Mounting ears 79 are each constructed in the shape of a vertically elongate, flat, rectangularly shaped plate having one of its side edges welded to the exterior surface of a column 20. Furthermore, in the preferred form illustrated, braces 70, 76 and 78 are formed from angle shaped structural steel, but it is to be understood that they can alternatively be constructed from other structural components, such as rectangular tubes or channels.

As illustrated in FIGS. 1–3, frame overhead section 18 is constructed from a pair of cross beams 66, each of which interconnect with the upper ends of a pair of columns 20 located at each end of frame structure 14. As discussed above, the end portion of each cross beam 66 is secured to an underlying mounting plate preferably by capscrews 64 which engage with nuts 67. Ideally, for maximum strength, cross beams 66 are constructed from wide flange I-beam members. A longitudinally extending center beam 80 spans between the centers of cross beams 66. Center beam 80 overlies cross beam 66 and is fixedly attached thereto, for instance, by welding. To maximize its capacity to carry bending loads, center beam 80 is also ideally constructed from a wide flange I-beam member.

It will be appreciated that constructing frame overhead section 18 from cross beam 66 and central beam 80 results in an easily and inexpensively fabricated structure which is capable of carrying very large loads. However, to support the high loads required to compact refuge in containers which are significantly larger in size than the particular container 10, illustrated in FIGS. 1–3, frame overhead section 18 might have to be additionally reinforced by other structural members to prevent it from racking or otherwise deforming during compaction.

Again referring to FIGS. 1–3, a pair of flat, vertically disposed hanger plates 82 depend downwardly from the underside of each cross beam 66. Ideally each hanger plate 82 is positioned equidistant from center beam 80 to thereby align garbage container 10 directly beneath pressing head 30. Hanger plates 82 can be welded, or otherwise attached by any convenient means, to the underside of cross beams 66. A transverse through hole is provided in each hanger plate 82 to accept a threaded cross pin 84 which also extends through aligned holes provided in the legs of a clevis 86 to engage with a nut 85. The upper end of each tension line 26 is looped through a clevis 86 and then clamped over to itself by a double set of "C" clamps 87. A hook 88 with a conventional safety latch is securely attached to the lower end portion of each line 26. Hooks 88 are sized to detachably engage with the holes provided in eye plates 46 which extend upwardly from the upper rim portion of garbage container 10. When pressing head 30 is disposed in an upwardly retracted position with stop plates 86 bearing against outer tube 56, as shown in FIG. 3, lines 26 are in relaxed condition and are long enough so that hooks 88 can be conveniently engaged with or disengaged from eye plates 46.

In preferred form, tension lines 26 are constructed from steel wire rope to ensure that they are capable of carrying the load of compaction. However, other material or other types of lines, such as chains, can be used as long as they are capable of withstanding the tensile loads transmitted through lines 26 during compaction of refuge within container 10.

Extend-retract members for lowering and lifting pressing head 30 are illustrated in FIGS. 1–3 as composed of a pair of hydraulic cylinders 28 which depend downwardly from center beam 80. Cylinders 28 are equally spaced apart in opposite directions from the longitudinal center of beam 80. The upper end portion of each cylinder 28 is pivotally connected to a U-shaped mounting yoke 90 by pivot pin 92. Each mounting yoke 90 is fixed to the underside of center beam 80 by any convenient means, for instance by welding. The free or lower end of the cylinder rod 93 of each cylinder 28 terminates in a downwardly open yolk 94 which straddles an intermediate cross member 98 of pressing head frame structure 100. Yoke 94 and cross member 98 are pivotally interconnected by a crosspin 96 which extends through clearance holes formed in each leg of yoke 94 and in cross member 98.

Preferably cylinders 28 are powered by hydraulic fluid rather than an alternative medium, such as air. Applicant has found that utilizing hydraulic fluid enables cylinders 28 to reliably provide a maximum compacting force at a minimum of expense. However, cylinders 28 can alternatively be powered by compressed air or even replaced with electrical solenoids or a rack and pinion arrangement without departing from the scope of the present invention.

Again referring specifically to FIG. 1, hydraulic fluid is provided to cylinders 28 by a pump 102 powered by an electric motor 104, both mounted on the flat bed 105 of a triangularly shaped bracket 106. Bracket 106 also includes an upright leg 108 which vertically spans between horizontal side brace 76 and diagonal side brace 70 of the right side of frame 14, as shown in FIG. 1. Bracket 106 further includes a diagonal leg 110 which extends diagonally upwardly and outwardly from an intermediate portion of upright leg 108 to intersect the laterally outwardly side of bracket bed 105. The opposite side of bed 105 is fixed to the upper end of vertical leg 108 at an elevation corresponding to horizontal side brace 76.

Hydraulic fluid is forced by pump 102 to either the upper end of cylinders 28 through lines 112 to extend cylinder rods 93 downwardly, or alternatively, through lines 114 to the lower end of cylinders 28 to retract their corresponding cylinder rods 93 upwardly.

An electrical switch 111 is mounted on the right rear column 20, as shown in FIG. 1, and contains buttons 140 and 142 for controlling the direction of rotation of motor 104 and pump 102 to thereby raise or lower pressing head 30, respectively. A third button 144 turns motor 104 on and off. For safety reasons, a keyed switch 115 is wired into the lines 116 and 117 carrying electric current to motor 104 to thereby prevent operation of compacting apparatus 12 by unauthorized individuals.

As most clearly illustrated in FIG. 1, pressing head 30 is disposed in substantially horizontal orientation at an elevation above garbage container 10 and below frame overhead section 18 by cylinders 28. Pressing head 30 is disposed in substantially horizontal orientation at an elevation above garbage container 10 and below frame overhead section 18 by cylinders 28. Pressing head 30 is generally planar form, having a rectangular outer contour corresponding to the shape of open top 32 of container 10. Further, pressing head 30 is constructed from a frame structure 100 which includes elongate side rails 119 interconnected at their ends by transversely extending end rails 120. Side rails 119 and end rails 120 cooperate to form the rectangularly shaped perimeter of frame structure 100. A pair of longitudinally extending, parallel spaced apart brace members 122 interconnect intermediate portions of end rails 120. Side rails 119 and longitudinal brace members 122 are interconnected by a pair of transversely extending, intermediate cross members 98. Each cross member 98 includes end portions extending between side rails 119 and corresponding longitudinal braces 122, and a central portion extending between the two longitudinal brace members 122. Intermediate cross members 98 are spaced apart a distance corresponding to the distance separating yokes 90 which pivotally connect cylinders 28 to the underside of center beam 80. Preferably the components of pressing head frame structure 100 are formed from angle-shaped structural material, but other types of structural material such as tubing or channels, can also be utilized. Furthermore, for economy of construction and maximum rigidity, ideally the components of frame structure 100 are welded together.

A flat, rectangularly shaped sheet 128 is attached to the underside of pressing head frame structure 100 by any convenient means, such as by bolting or riveting. Sheet 100 serves to bear against the refuge, or other material, located within container 10. The perimeter of sheet 128 closely matches the perimeter of pressing head frame structure 100 which is ideally slightly smaller than the size of container top opening 32, thereby establishing a clearance gap between pressing head 30 and the side walls of container 10. This gap serves to accommodate any misalignment between pressing head 30 and container 10 as when the pressing head enters the container. For economy of construction, sheet 128 is preferably formed from a high grade of plywood material, i.e. exterior sheathing or marine grade.

Pressing head 30 also includes a flexible, resilient seal member 130, which in the preferred form illustrated, is constructed from elongate strips of rubber, or similar material, having their inner edge portions sandwiched between the perimeter of pressing head frame structure 100 and flat sheet 128. Seal member 130 extends outwardly from the perimeter of frame structure 100 to close off the gap between pressing head 30 and container 10 to prevent flies, rodents and other pests from entering container 10. Rather than utilizing a thin strip of rubber to construct seal member 130, the seal member can be formed from other resilient materials, such as sponge rubber formed in a rectangular cross section somewhat similar to that commonly utilized to seal the edges of a door against a door jamb.

To utilize the present invention to compact refuge, with pressing head 30 retracted upwardly, container 10 is placed within compacting apparatus 12 by rolling the container on guide rails 50 to thereby nominally locate the container below pressing head 30. Next, lines 26 are connected to container 10 by placing hooks 88 through the corresponding apertures in eye plates 46. Rather than utilizing eye plates 46, apertures can be formed in the upper edge portion of container 10 itself. Further, the portion of the container end walls 40 in the region of the apertures can be reinforced by welding or otherwise affixing a cheek plate, not shown, to the end walls.

With hooks 88 engaged with eye plates 46, pressing head 30 can be raised upwardly to its retracted position, as illustrated in FIG. 2 to provide enough clearance between pressing head 30 and the top of container 10 to enable garbage and other refuge to be conveniently dumped within the container. Thereafter, cylinders 28 can be extended to lower pressing head 30 into container 10 to serve as a cover for the container. The rubber strip member 130 serves to seal the clearance gap existing between pressing head frame structure 100 and the side walls of container 10 to prevent pests, such as rodents or flies, from entering the container. Additional refuge can be conveniently placed within container 10 by simply utilizing hydraulic cylinders 28 to retract pressing head 30 upwardly. No heavy covers must be lifted or pivoted upwardly and then held open while attempting to simultaneously place materials within container 10.

Preferably cylinders 28 are of a length that when fully extended they support pressing head 30 at an elevation slightly below the upper rim of container 10. This design reduces the possibility of injury if a person accidentally falls within container 10 as pressing head 30 is lowered. Nevertheless, if desired, cylinders 28 can be lengthened so that pressing head 30 extends downwardly to substantially the full depth of container 10. However, applicant has found that pressing head 30 does not have to be designed to extend to the bottom of container 10 to tightly compact garbage within the container. Rather, the garbage within container 10 is densely compacted when pressing head 30 is limited to extend only a short distance down into container 10.

Once container 10 has been filled to a level above the maximum penetration depth of pressing head 30, the pressing head acts to compact the refuge within the container. When pressing head 30 pushes downwardly against the garbage within container 10, an opposite, upwardly directed reaction force is generated, which reaction force acts through cylinders 28 to cause frame overhead section 18 to raise upwardly thereby sliding inner tube 22 of telescoping columns 20 upwardly out from the upper end of outer tube 24. Frame overhead section 18 is free to lift upwardly until lines 26 are fully tensioned whereupon the lines exert a lifting force on the upper rim portion of container 10. However, the downward compacting force of pressing head 30 prevents lines 26 from lifting container 10 off of rails 50. In net effect, the compaction load imposed on the refuge within container 10 by pressing head 30 is transferred by lines 26 back up to frame overhead section 18. As a consequence, the load of compaction is carried by lines 26 and is not transmitted through container wheels 42 or mounting yolks 44, which components are typically not designed to withstand such forces.

After pressing head 30 has been forced downwardly within the upper portion of container 10 to compact the refuge therein, electric motor 104 for pump 102 can be simply de-energized thereby leaving pressing head 30 within container 10 so that the pressing head can serve as a top or cover for the container. Additional refuge can be compacted within container 10 by energizing motor 104 to cause pump 102 to force hydraulic fluid through lines 114 to the lower end of cylinders 28 to thereby lift pressing head 30 upwardly away from container 10. Once pressing head 30 is retracted, additional materials can be placed within the upper portion of container 10 and then cylinders 28 can be extended to compact this additional material. This process can be repeated until the refuge within container 10 is compacted so tightly that pressure relief valve, which limits the hydraulic pressure transmitted to cylinders 28, is activated to thereby control the maximum compacting force of pressing head 30. Applicant has found that the use of compacting apparatus 12 enables up to three times the amount of refuge to be placed within a given size of storage container as opposed to the volume of refuge which the container could accommodate if the refuge is not compacted.

Once the maximum volume of refuge has been placed within container 10, overhead frame section 18 is retracted upwardly thereby causing telescoping columns 20 to collapse until stop plate 68 bears against the upper end of outer tube 24. When telescoping columns 20 are fully collapsed, tension lines 26 assume a slack condition as illustrated in FIG. 2 so that hooks 88 can be removed from eye plates 46. Thereafter, container 10 is rolled out from frame structure 14 and then emptied into a larger receptacle, not shown, such as a garbage truck. After it has been emptied, container 10 is wheeled back into place within frame 14 and is again ready to be filled.

The invention may be embodied in other specific forms or embodiments without departing from the spirit or essential characteristics thereof. The typical embodiments of the material compacting apparatus described above, are therefore to be considered in all respects asillustrative and not restrictive. The scope of the invention is set forth in the appended claims rather than being limited to the specific typical embodiments of the material compacting apparatus described in the foregoing description.

What is claimed is:

1. A compacting apparatus for use with a container having a charging opening for receiving material to be compacted therein, said compacting apparatus comprising:

a collapsible frame structure having a stationary base section, a movable section spaced away from the container, and means for interconnecting said stationary and movable sections to permit said movable section to shift toward and away from the container from an initial position collapsed relative to said frame base section;

pressing means disposed between said frame movable section and the container, said pressing means sized to slidably pass through the container charging opening;

extend-retract means interconnecting said frame movable section with said pressing means to power said pressing means between a compacting mode forcing said pressing means into the container to compact the material located therein, and a retracting mode retracting said pressing means to a position spaced away from the container charging opening;

connection means mounted on the container;

flexible lines interconnecting said frame movable section with said container connection means;

wherein during the compacting mode said frame movable section is free to shift away from said frame base section and the container in response to the reaction force generated by said pressing means pressing against the material within the container, until said lines are taut whereupon said lines align the container with said pressing means and transmit the compaction force exerted on the container, by said pressing means, back to said frame movable sections, and during the retracting mode said lines are relaxed and said frame movable section is in collapsed position relative to said frame base section.

2. A compacting apparatus according to claim 1, wherein said frame structure interconnection means including a plurality of pairs of tubular sections telescopically engageable with each other, with the end portion of one tubular section rigidly connected to said frame base section and the opposite end portion of the second tubular section rigidly connected to said frame movable section.

3. A compacting apparatus according to claim 2, further comprising stop means for limiting the maximum engagement between the two tubular sections of each pair of telescoping tubular sections.

4. A compacting apparatus according to claim 1, wherein said frame movable section is disposed above said base section, and said means for interconnecting said stationary and movable frame sections includes a plurality of telescoping means, each composed of a lower section rigidly attached to said frame base section and an upper section telescopically engageable with said lower section and rigidly connected to said movable section.

5. A compacting apparatus according to claim 4, wherein said extend-retract means includes at least one fluid ram depending downwardly from said frame movable section, said ram having an upper end portion connected to said frame movable section and a lower end portion connected to said pressing means.

6. A compacting apparatus according to claim 4, wherein said extend-retract means includes a pair of spaced apart rams depending downwardly from said frame movable section, each of said rams having their upper end portions pivotally connected to said frame movable section and their lower end portions pivotally connected to said pressing means.

7. A compacting apparatus according to claims 1 or 6, wherein said pressing means further includes a substantially flat pressing head shaped to correspond to the shape of the container charging opening and sized slightly smaller than the charging opening to provide a clearance gap between the perimeter of said pressing head and the charging opening.

8. A compacting apparatus according to claim 7, wherein said pressing means further includes a flexible seal member extending outwardly from the perimeter of said pressing head to seal the gap between said pressing head and the container charging opening.

9. A compacting apparatus according to claim 1, wherein said frame base section includes guide means for guiding the container into position relative to said base frame for nominally locating said container relative to said pressing means.

10. A compacting apparatus according to claim 1, wherein:

said connection means includes apertures formed in the edge portion of said container adjacent the charging opening; and further comprising a hook attached to the end of each line opposite said frame movable section for engaging with said connection means apertures.

11. A compacting apparatus according to claim 1:

further comprising a hook attached to the end of each line opposite said frame movable section; and wherein said connection means includes a plurality of eye plates fixedly attached to the rim portion of said container and extending outwardly from said container, each of said eye plates including an aperture for receiving one of said hooks therethrough.

12. A garbage compactor according to claims 10 or 11, wherein each of said lines includes a length of wire rope with the end portion of each length of wire rope opposite said hook pivotally connected to said frame movable section.

13. A compacting apparatus according to claim 12, wherein each of said lines is slightly longer than the distance separating the location wherein said line is connected to said frame movable section and the location of the hook receiving aperture to enable each of said lines to be in slack condition when said pressing means are in retracted position and said frame movable section is in collapsed position.

14. A compactor for use with a translatable container formed with an open top, comprising:

a frame structure including a base section, an overhead section disposed above said base section and said container, and a plurality of telescoping columns, each composed of a pair of tubular sections slidably engageable with each other for guiding said overhead section and said base section for movement toward and away from each other;

tension means interconnecting said frame overhead with an upper portion of the container;

pressing means disposed below said frame upper section and sized to pass through the container open top; and extend-retract means interconnecting said frame overhead section with said pressing means to power said pressing means between a retracted position spaced above the container opening and a ramming position extending into the container through its open top to lift said frame overhead section upwardly away from said frame base section until said tension means are in taut condition wherein said tension means prevents further relative movement between said frame overhead and base sections by transmitting the ramming load exerted on said pressing means by said extent-retract means through said tension means and back overhead section.

15. A compactor according to claim 14, wherein said frame structure base section includes guide means for guiding said container into position relative to said frame structure for nominally locating said container below said pressing means.

16. A compactor according to claim 14, further comprising stop means for limiting the maximum telescoping engagement between the two tubular sections of each of said columns.

17. A compactor according to claim 14, wherein said tension means includes a plurality of flexible lines having a lower end portion, and an upper end portion connected to said frame structure overhead section; and connecting means for detachably connecting the lower end portion of each of said lines with an upper rim portion of the container.

18. A compactor according to claim 17, wherein said connecting means includes openings formed in the upper rim portion of said container and hooks secured to the lower end portion of each of said flexible lines for detachably engaging within a corresponding container opening.

19. A compactor according to claim 17, wherein said connecting means includes:

a plurality of eye plates extending upwardly from the upper rim portion of the container, each said eye plates including portions forming an aperture extending therethrough; and a hook attached to the lower end portion of each of said flexible lines for extending through a corresponding eye plate aperture.

20. A compactor according to claim 14, wherein said pressing means includes a reinforced pressing head shaped to correspond to the shape of the container top opening and sized slightly smaller than the container top opening to provide a clearance gap between the perimeter of said pressing head and the container top opening.

21. A compacting apparatus according to claim 20, wherein said pressing head further includes a flexible seal member extending outwardly from the perimeter of said pressing head to seal the gap between said pressing head and the container when said pressing head is disposed therein.

22. A compactor according to claim 14, wherein said extend-retract means includes a plurality of fluid rams depending downwardly from said frame structure, each of said rams having an upper end portion pivotally connected to said frame overhead section and a lower end portion pivotally connected to said pressing head.

23. A material compacting apparatus for use with a wheeled, material receiving container including sidewalls and an open top, said apparatus comprising:

a frame structure having a plurality of extensible columns, and a horizontally disposed framework supported by the upper ends of said columns at an elevation above the container for movement relative to the container;

a plurality of flexible lines interconnecting said framework with an upper rim portion of said container;

pressing means suspended beneath said framework for compacting material into said container;

fluid operated means interconnecting said frame structure with said pressing means to lift said pressing means upwardly above said container, and to alternatively power said pressing means downwardly into said container thereby urging said framework upwardly away from said container until said flexible lines are drawn into taut condition in reaction to the ramming load exerted on said pressing means by said fluid operating means, thereby preventing further movement of said framework upwardly away from said container.

24. A material compacting apparatus according to claim 23, wherein said frame structure further includes a base portion for supporting the lower end portions of said columns fixed relative to each other.

25. A material compacting apparatus according to claim 24, wherein said frame structure base portion includes guide means for guiding said container into position relative to said frame structure for nominally locating said container below said pressing means.

26. A material compacting apparatus according to claim 25, wherein said guide means includes elongate tracks for constraining said container wheels during movement of said container relative to said frame structure base portion and for supporting said container wheels when said container is disposed beneath said plunger means.

27. A material compacting apparatus according to claim 23, wherein each of said extensible columns including a pair of tubular, telescopically engageable sections, with the upper end of one of said sections rigidly connected to said framework.

28. A material compacting apparatus according to claim 23 or 27, further comprising stop means for limiting the downward movement of said framework relative to the container.

29. A material compacting apparatus according to claim 23, further comprising connecting means for detachably interconnecting the lower end portion of each said flexible lines with an upper rim portion of the container.

30. A material compacting apparatus according to claim 29, wherein said connecting means includes apertures formed in the upper rim portions of said container, and hooks fixed to the lower end portions of each of said flexible lines for detachably engaging within a corresponding aperture.

31. A material compacting apparatus according to claim 29, wherein said connecting means includes:

a plurality of eye plates fixedly attached to the sidewalls of said container to extend outwardly therefrom, each of said eye plates including portions forming an aperture extending therethrough; and a hook attached to the lower end portion of each of said flexible lines for engaging through a corresponding eye plate aperture.

32. A material compacting apparatus according to claim 23, wherein said pressing means includes a reinforced pressing head having a shape corresponding to the shape of the container opening and sized slightly smaller than the container opening to define a clearance gap between the perimeter of said pressing head and the container opening.

33. A material compacting apparatus according to claim 32, wherein said pressing means further includes a resilient seal member extending outwardly from the perimeter of said pressing head to close the gap extending between said pressing head and the container sidewalls when said pressing head is disposed within said container.

34. A material compacting apparatus according to claim 23, wherein said fluid operated means includes at least one fluid ram depending downwardly from said frame structure, and fluid supply means for providing fluid under pressure to force said ram downwardly to compact material into said container and to retract said pressing means to an elevation spaced above said container.

35. A material compacting apparatus according to claim 34, wherein said fluid operated means includes a pair of spaced apart hydraulic rams depending downwardly from said frame structure, each of said rams having an upper end portion pivotally connected to said framework of said frame structure and a lower end portion pivotally connected to said pressing means.

* * * * *